US009914242B2

(12) United States Patent
Jacques et al.

(10) Patent No.: US 9,914,242 B2
(45) Date of Patent: Mar. 13, 2018

(54) MOULDING DEVICE AND PRODUCTION PROCESS

(71) Applicant: LAFARGE, Paris (FR)

(72) Inventors: Laurence Jacques, Courbevoie (FR); Thibault Lagrange, Paris (FR)

(73) Assignee: LAFARGE, Paris (FR)

( * ) Notice: Subject to any disclaimer, the term of this patent is extended or adjusted under 35 U.S.C. 154(b) by 548 days.

(21) Appl. No.: 14/328,462

(22) Filed: Jul. 10, 2014

(65) Prior Publication Data

US 2014/0319719 A1 Oct. 30, 2014

Related U.S. Application Data

(62) Division of application No. 13/319,878, filed as application No. PCT/FR2010/050885 on May 7, 2010, now abandoned.

(30) Foreign Application Priority Data

May 20, 2009 (FR) ..... 09 02246

(51) Int. Cl.

| | |
|---|---|
| ***B28B 3/00*** | (2006.01) |
| ***B28B 3/02*** | (2006.01) |
| ***B28B 7/00*** | (2006.01) |
| ***B28B 7/06*** | (2006.01) |

(52) U.S. Cl.

CPC ..... *B28B 3/003* (2013.01); *B28B 3/006* (2013.01); *B28B 3/024* (2013.01); *B28B 7/0023* (2013.01); *B28B 7/06* (2013.01)

(58) Field of Classification Search

CPC . B28B 3/003; B28B 3/006; B29C 2043/3621; B29C 2043/563

See application file for complete search history.

(56) References Cited

U.S. PATENT DOCUMENTS

| | | | |
|---|---|---|---|
| 3,492,392 | A | 1/1970 | Kasmatsu et al. |
| 5,464,337 | A | 11/1995 | Bernardon et al. |
| 2009/0309272 | A1 | 12/2009 | Behloul et al. |

FOREIGN PATENT DOCUMENTS

| | | |
|---|---|---|
| DE | 41 40 012 | 6/1992 |
| EP | 0 393 767 | 10/1990 |
| EP | 0 518 777 | 12/1992 |
| EP | 0 934 915 | 8/1999 |
| FR | 1 214 175 | 4/1960 |
| FR | 2 908 066 | 5/2008 |
| GB | 1 466 663 | 3/1977 |
| WO | WO 95/01316 | 1/1995 |

(Continued)

OTHER PUBLICATIONS

International Search Report issued for International Application No. PCT/FR2010/050885, dated Oct. 14, 2010.

(Continued)

*Primary Examiner* — James Sanders

(74) *Attorney, Agent, or Firm* — Pillsbury Winthrop Shaw Pittman LLP

(57) ABSTRACT

A production process includes introducing the material to be moulded into a mould, placing the mould in an envelope comprising a vacuum port; creating a low pressure in the envelope by formation of a gas flow through the vacuum port; deforming the mould; stopping the gas flow; and applying pressure on at least a portion of the mould, optionally with interposition of the envelope, at least after the gas flow is stopped.

9 Claims, 5 Drawing Sheets

(56) References Cited

FOREIGN PATENT DOCUMENTS

| | | |
|---|---|---|
| WO | WO 95/01317 | 1/1995 |
| WO | WO 99/23046 | 5/1999 |
| WO | WO 99/28267 | 6/1999 |
| WO | WO 99/58468 | 11/1999 |
| WO | WO 01/58826 | 8/2001 |
| WO | WO 2008/056065 | 6/2008 |

OTHER PUBLICATIONS

International Preliminary Report on Patentability issued for International Application No. PCT/FR2010/050885, dated Nov. 24, 2011.

MOULDING DEVICE AND PRODUCTION PROCESS

CROSS-REFERENCE TO RELATED APPLICATIONS

This application is a divisional application of U.S. patent application Ser. No. 13/319,878, filed Nov. 18, 2011 which in turn is the U.S. National Stage of PCT/FR2010/050885, filed May 7, 2010, which in turn claims priority to French Patent Application No. 0902246, filed May 11, 2009, the entire contents of all applications are incorporated herein by reference in their entireties.

The present invention relates to a moulding device of parts in a material to be moulded, for example concrete, and to a process of production of parts of said material by moulding.

Document WO2008/056065, in the name of the Applicant, describes a production process of concrete parts consisting of introducing a material to be moulded into a mould, placing the mould in an envelope, creating a low pressure in the envelope in order to hold the walls of the mould in place, and deforming the mould. After the concrete sets, the mould may be removed from the envelope. Moulded parts may be produced by this process in a simple manner. The low pressure is generally created in the mould using a vacuum pump, which operates by aspirating the air in the envelope.

Although this process operates quite satisfactorily, the Applicant has shown that, for certain applications, more or less important undesirable deformations could occur on the moulded parts. These deformations are related to a differential shrinkage of the moulded part due to non-uniform dehydration.

There is therefore a need for a device and a moulding process to produce parts in which the mould is contained in an envelope in which a low pressure is created and which makes it possible to reduce, or even eliminate, the undesirable deformations of the moulded parts.

With this aim, the present invention provides a moulding device comprising:

- an envelope;
- a mould, the mould being in the envelope;
- a vacuum port designed to let a gas flow pass in order to create a low pressure in the envelope;
- an obturating element designed to interrupt said gas flow after the low pressure is created;
- a deforming member of the mould, and
- a means, different from the envelope and the deforming member, designed to exert pressure on at least a portion of the mould, optionally with interposition of the envelope, once the low pressure is created.

According to an example of an embodiment, the device further comprises a vacuum pump and a connecting element designed to connect the vacuum pump to the envelope.

According to an example of an embodiment, the obturating element is incorporated into the vacuum pump.

According to an example of an embodiment, the mould comprises at least first and second opposing faces. The deforming member is adapted to apply a first pressure on the mould, with interruption of the envelope, on the side of the first face. Said means is adapted to apply a second pressure on the mould, with interruption of the envelope, on the side of the second face.

According to an example of an embodiment, the deforming member is selected from the group comprising a jack and a template.

According to an example of an embodiment, said means comprises at least one load having a mass greater than one kilogram and intended to rest on at least one portion of the mould, optionally with interposition of the envelope, once the low pressure is created.

According to an example of an embodiment, said means has a shape at least partially complementary to the template.

According to an example of an embodiment, the device further comprises at least one draining element in the form of a sheet or membrane in the envelope.

According to an example of an embodiment, the device further comprises at least two draining elements in the envelope, the mould being interposed between the two draining elements.

The invention also relates to a production process, comprising the following steps:

- introducing a material to be moulded into a mould;
- placing the mould in an envelope comprising a vacuum port;
- creating a low pressure in the envelope by the formation of a gas flow through the vacuum port;
- deforming the mould by a deforming member;
- stopping the gas flow; and
- applying pressure, by a means different from the envelope and the deforming member, on at least a portion of the mould, optionally with interposition of the envelope, at least after the gas flow is stopped.

According to an example of an embodiment, the vacuum port is connected to a vacuum pump by a connecting element. The step of creating the low pressure comprises turning the vacuum pump on and the step of stopping the gas flow comprises turning the vacuum pump off.

According to an example of an embodiment, the step of stopping the gas flow comprises at least partially obturating the connecting element.

According to an example of an embodiment, the mould is deformed by a deforming member selected in the group comprising a jack and a template.

According to an example of an embodiment, the mould comprises at least first and second opposing faces. The deforming member applies a first pressure on the mould, with interposition of the envelope, on the side of the first face. Said means applies a second pressure on the mould, with interposition of the envelope, on the side of the second face.

According to an example of an embodiment, the step of applying pressure comprises placing at least one load on at least a portion of the mould, optionally with interposition of the envelope.

According to an example of an embodiment, said means applies a substantially uniform second pressure on the mould, with interposition of the envelope, over more than half of the second face.

Through many trials, the Applicant has shown that the shrinkage was at least partly due to the water vapour present in the envelope being aspirated by the vacuum pump when the latter is connected to the envelope by the vacuum port to create the low pressure in the envelope. This results in accelerated drying of the moulding material, capable of causing undesirable deformations of the moulded part.

The Applicant has shown that, once created, the low pressure in the envelope is only slowly reabsorbed even when the gas flow, which led to the forming of the low pressure in the envelope, is stopped. The mould is then advantageously held in place by the envelope during deformation of the mould and simultaneously the time is shortened during which water vapour is extracted from the envelope. Undesirable drying of the material to be moulded is thus reduced and the shrinkage of the material to be moulded is reduced.

Furthermore, by exerting on the mould, in addition to the pressure exerted by the envelope, additional pressure by a means other than the envelope in order to keep the mould in position, the mould is advantageously held in place in the desired deformed configuration.

The expression "hydraulic binder" is understood according to the present invention to mean for example a pulverulent material which, when mixed with water, forms a paste that sets and hardens by a series of hydration reactions and processes and which, after hardening, preserves its strength and its stability, even under water.

The term "concrete" is understood for example to mean a mix of hydraulic binder, aggregates, water, optionally additives and optionally mineral additions, for example high-performance concrete, very high-performance concrete, self-placing concrete, self-levelling concrete, self-compacting concrete, fibre-reinforced concrete, ready-mixed concrete or coloured concrete. The term "concrete" is also understood for example to mean concretes that have undergone a finishing operation, such as bush-hammered concrete, deactivated or washed concrete, or polished concrete. This definition also includes pre-stressed concrete. The term "concrete" includes mortars. In this specific case, the concrete comprises a mix of hydraulic binder, sand, water and optionally additives and optionally mineral additions. According to the invention, the term "concrete" denotes indistinctly fresh concrete and hardened concrete.

According to the invention, the term "aggregates" denotes for example gravel, coarse aggregates and/or sand.

The term "setting" is understood according to the present invention to mean the process whereby a hydraulic binder passes into the solid state by chemical hydration reaction. Setting is generally followed by a hardening period.

The term "hardening" is understood according to the present invention to mean the acquisition of mechanical properties of a hydraulic binder after the end of setting.

Other characteristics and advantages of the invention will appear on reading the following detailed description of embodiments of the invention given solely by way of example and with reference to the drawings in which.

The same elements are denoted on the various figures by the same references. Furthermore, only the elements necessary to understand the present invention are described and shown in the figures.

Figure 1:
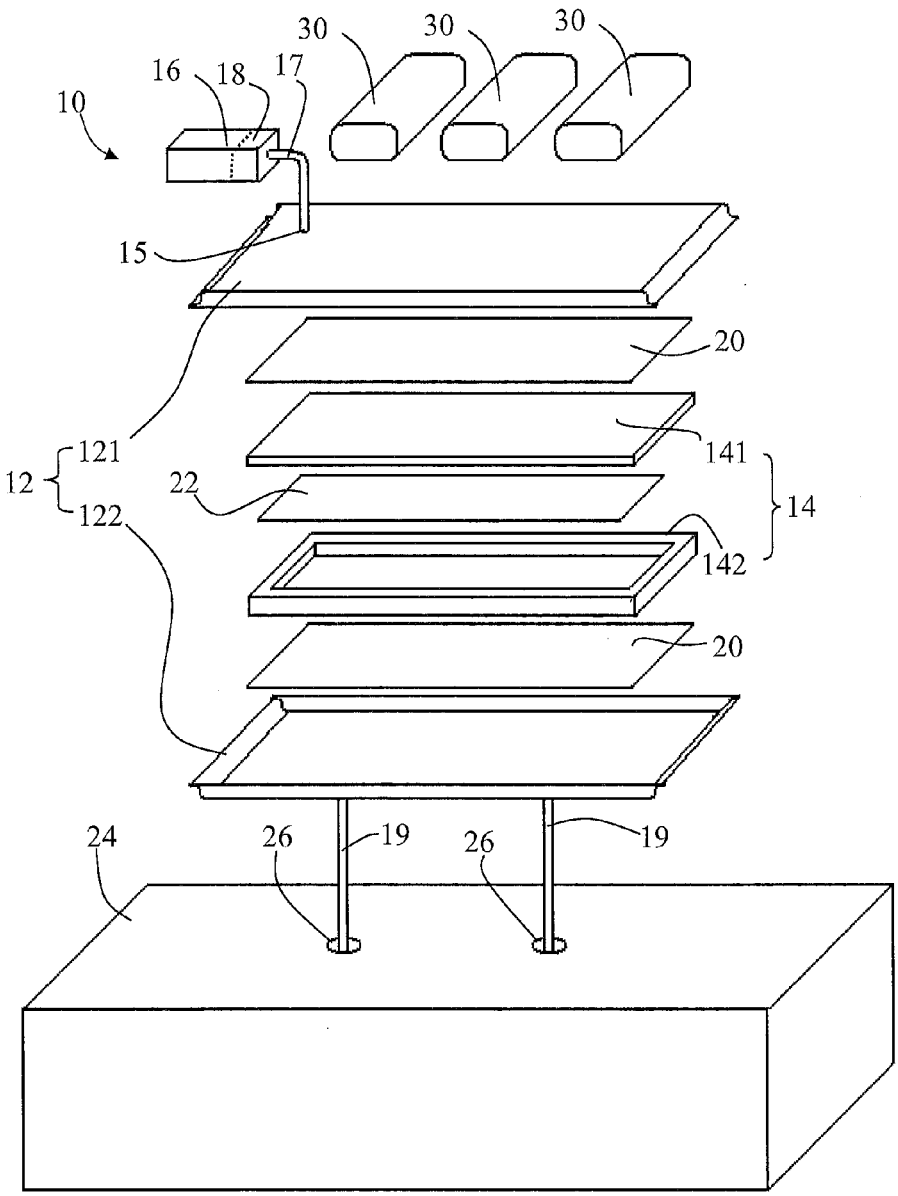
FIGS. 1 and 2 are an exploded diagrammatic view in perspective and an exploded lateral cross section, respectively, of a moulding device according to a first example of an embodiment of the invention.
Figure 2:
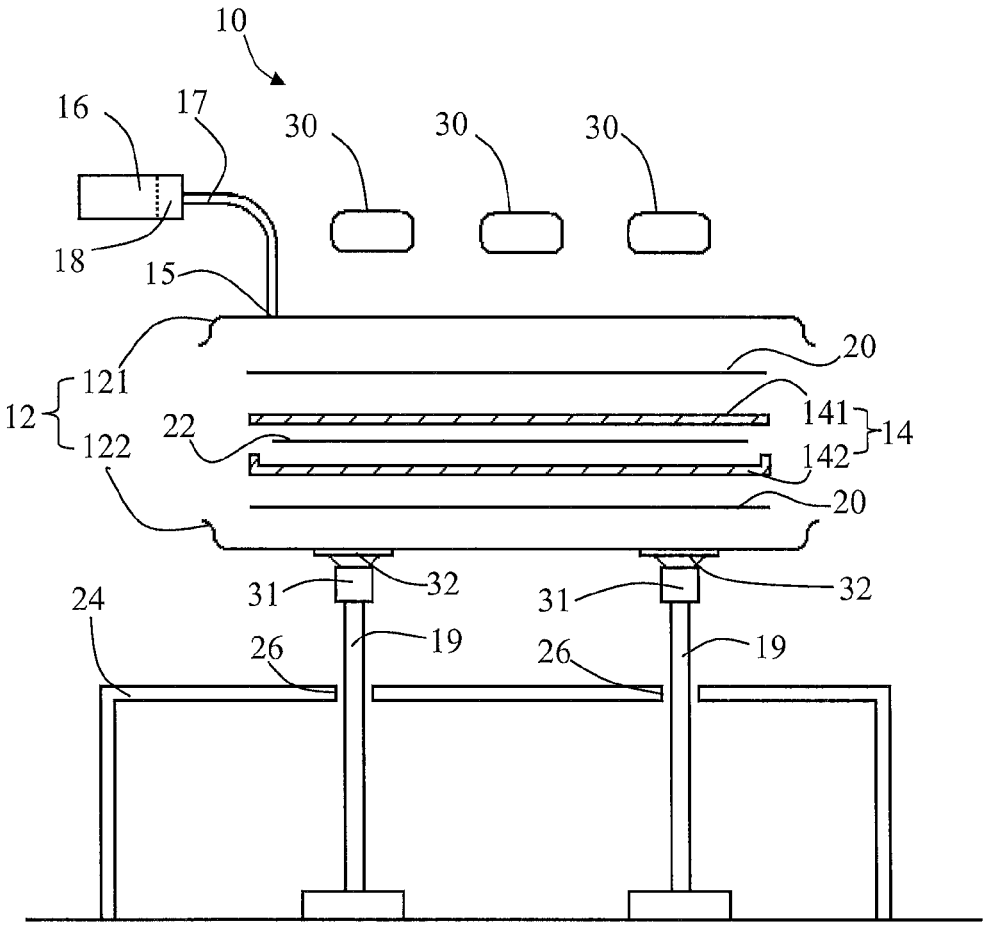

FIGS. 1 and 2 represent diagrammatically a moulding device 10 according to a first example of an embodiment of the invention, in an exploded perspective view and an exploded lateral cross section, respectively. The device 10 may be used to mould parts having particular shapes. In particular, facings of aesthetic forms for architectural or civil engineering structures may be produced. Parts with aesthetic forms may be produced with a concrete-type of initial material.

The device 10 comprises an envelope 12 and a mould 14 which, during part of the moulding process, is placed in the envelope 12. The mould 14 is designed to receive the material used to make the parts, for example concrete. The envelope 12 includes a vacuum port 15 designed to be connected to a vacuum pump 16 by a connecting element 17, for example a pipe or hose. The vacuum pump 16 is, for example a vane pump (lubricated or dry), a piston pump, a liquid-ring pump, a diaphragm pump, a vacuum ejector using vapour or a compressed gas, a Roots pump or a dry (non-lubricated) pump. When it is not connected to the connecting element 17, the vacuum port 15 is in a closed state, i.e. it does not allow a flow of gas to pass through it. The vacuum pump 16 is designed to create a low pressure, or vacuum, in the envelope 12 relative to atmospheric pressure. By way of example, a low pressure in the envelope 12 relative to atmospheric pressure may be obtained, using the vacuum pump 16, of for example −0.5 bar or less, for example −0.8 bar or less, for example, equal to −0.9 bar. The device 10 may be sufficiently rigidified by the low pressure in the envelope 12 so that the material to be moulded does not shift inside the mould 14 when the mould 14 is submitted to deformation. The material can then remain at a constant thickness in the mould 14. The low pressure allows the constituent elements of the moulding device 10 to become integral. In particular, the envelope 12 and/or the mould 14 may each be provided with two lips on their periphery and which are pressed against each other under the effect of the low pressure. These lips ensure in a simple manner the closing of the envelope 12 and of the mould 14 respectively. The use of mechanical sealing means may thus be avoided. The lips may also be made with a fold on one of the lips and a groove on the other of the lips, the low pressure provoking the fold to penetrate in the groove in order to ensure better sealing of the envelope 12 and/or the mould 14.

Advantageously, by creating the low pressure within the envelope 12, pumping of the material located in the mould 14 is avoided. The air trapped in the envelope 12 is aspirated by the vacuum port 15. If the vacuum port 15 were able to create a low pressure directly in the mould 14, the material to be moulded would also risk being pumped. Thus, the moulding material is confined by the mould 14 inside the envelope 12 and simultaneously a low pressure can be created in the envelope 12.

The envelope 12 comprises for example a top portion 121 and a bottom portion 122. The mould 14 is placed between the bottom portion 122 and top portion 121. The mould 14 rests on the bottom portion 122. The mould 14 may simply be sandwiched by the envelope 12. It is sufficient to place the mould 14 on the bottom portion 122 and to close the envelope using the top portion 121, the top portion 121 acting as a cover. The envelope 12 is preferably made of a flexible material. The envelope 12, due to its flexibility, may be deformed. The envelope 12 is also flexible in order to favour the creation of the low pressure in the envelope 12. The envelope, due to its flexibility, may take on the shape of the mould 14 under the effect of the low pressure. For example, the envelope 12 is of a plastic material.

The mould 14 may comprise a top shell 141 and a bottom shell 142. The bottom shell 142 of the mould 14 rests on the bottom portion 122 of the envelope 12. The material to be moulded may be confined in a simple manner by the mould 14. The material is distributed over the bottom shell 142 of the mould, then the mould 14 is closed by means of the top shell 141. The mould 14 is preferably of a flexible material. The flexibility of the mould 14 has several advantages: the mould 14 may deform under the action of a deforming member; the mould 14 favours the confinement of the material in the mould under the effect of the low pressure created in the envelope 12; and better contact between the mould 14 and the material to be moulded may be obtained. By way of example, the mould 14 is of silicone or polyurethane.

The envelope 12 is provided with the vacuum port 15. Preferably, the vacuum port 15 is on the top shell 121. The envelope 12 may rest in operation on a support by virtue of its bottom portion 122. Since the mould 14 rests on the bottom portion 122 of the envelope 12, it is preferable to provide the vacuum port 15 on the top portion 121 of the envelope 12 in order to facilitate the creation of the low pressure.

The device 10 comprises an obturating element 18 which is designed, when the low pressure has been created in the envelope 12, to interrupt any gas flow through the vacuum port 15. The low pressure in the envelope 12 may be maintained whilst interrupting the functioning of the vacuum pump 16. However, after the vacuum pump 16 has been turned off, the pressure nevertheless tends to increase slowly in the envelope 12 due to leaks. However, the low pressure remains long enough in the envelope 12 to ensure that the mould 14 is held in place by the envelope 12. The obturating element 18 may be incorporated into the vacuum pump 16. In this case, the obturating element 18 may be automatically released to obturate one end of the connecting element 17 when the functioning of the vacuum pump 16 is interrupted. In FIGS. 1 and 2, the obturating element 18 is delimited diagrammatically by a dotted line in the vacuum pump 16.

The device 10 may also include at least one thin draining element 20 in the envelope 12, having the form of a membrane or sheet, etc. The draining element 20 favours the creation of the low pressure. The draining element indeed prevents the envelope 12 from locally adhering to the mould 14, under the effect of the low pressure created within the envelope 12, which could lead to air bubbles being trapped and hinder further creation of the low pressure. By way of example, the draining element 20 is of a woven or non-woven material. Such a material is not air-tight but allows the passage of air. While the low pressure is being created, the draining element 20 favours the circulation of air in the direction of the vacuum port 15. The draining element 20 is for example located between the top portion 121 of the envelope 12 and the top shell 141 of the mould 14. The draining element 20 thus favours the circulation of air between the top portion 121 and the top shell 141. Alternatively, the draining element 20 may be located between the bottom portion 122 of the envelope 12 and the bottom shell 142 of the mould 14. The draining element 20 therefore facilitates the circulation of air between the bottom shell 142 of the mould 14 and the bottom portion 122 of the envelope 12. The circulation of air is all the more favoured when, due to gravity, the bottom shell 142 rests against the bottom portion 122 and the low pressure could be difficult to create in this zone of the envelope 12 in the absence of the draining element 20 because air bubbles would risk being trapped between the mould 14 and the envelope 12. The draining element 20 forms a buffer zone between the mould 14 and the envelope 12. Preferably, the device 10 comprises two draining elements 20 in the envelope 12, one of the draining elements 20 being placed between the top portion 121 and the top shell 141 and the other draining element 20 being placed between the bottom portion 122 and the bottom shell 142. The presence of two draining elements 20 favours the creation of the vacuum throughout the envelope 12.

A draining element 22 may be provided in the mould 14. The draining element 22 then favours the creation of the low pressure in the mould 14. The low pressure created in the envelope 12 also propagates into the mould 14 through the edges of the shells 141 and 142. However, the low pressure in the mould 14 is less important than the one present in the envelope 12, whereby the material to be moulded is not aspirated at the same time. The draining element 22 in the mould 14 also favours the circulation and aspiration of the air contained in the mould 14. The air contained in the mould 14 is mainly between the material to be moulded and the top shell 141 of the mould 14. The draining element 22 is therefore preferably located in this zone. Thus, the shell 141 is prevented from being pressed directly against the material, permitting air to circulate between the shell 141 and the material while the low pressure is created within the envelope 12. The draining element 22 may be made of the same material as the draining element 20 and allow the air to circulate.

An insert-guiding element (not shown) may be provided in the mould 14. This guiding element corresponds for example to a flexible sheet placed between the shell 141 and the material to be moulded and covering the material to be moulded. For example, the guiding element has openings for the passage of parts or inserts that partially or completely penetrate into the material to be moulded. The inserts are thus suitably positioned.

The device 10 includes at least one deforming member 19 (two separate deforming members 19 being shown in FIGS. 1 and 2) designed to conform to the mould 14 according to the desired shape in order to mould the material according to a particular shape. The envelope 12 and the mould 14 being flexible, they can deform under the action of the deforming member 19. A single deforming member 19 may be sufficient to shape the mould 14, for example by deforming a central zone of the mould 14. Preferably, several deforming members may be provided, in order to deform the mould 14 in several zones. In the text that follows, the device will be described with several deforming members, but the same comments apply when a single deforming member is provided.

The deforming members 19 of the mould 14 are beneath the mould 14. At rest, the mould 14 lies flat, and, when the deforming members 19 are activated, they deform the mould 14 against gravity. The advantage is that the practical embodiment of the deformation is simpler to do than if the mould was maintained vertically and the members 19 deformed the mould laterally. A problem would indeed arise to maintain the material in place in the mould if the mould were held vertically. There would be a risk of the material flowing within the mould and the thickness of the material would vary.

More precisely, the deforming members 19 act on the envelope 12. The organs 19 are in contact with the envelope 12. By the acting on the envelope 12, the mould 14 is deformed. The advantage is that the risks of puncturing the mould 14 are reduced since a double protection is provided by the envelope 12 and the mould 14. The deforming members 19 are therefore also located beneath the envelope 12. The action on the envelope 12 and the deformation of the mould 14 are done against gravity, by lifting or supporting the envelope 12 and the mould 14.

According to the first example of an embodiment, the deforming members 19 are for example jacks. The deforming members 19 may also be more simply metal rods, the height of which is adjusted by inserting shims between the base of the rod and the ground. The advantage of using jacks is that the shapes which may be obtained are infinite, it being understood that the jacks may occupy various positions. Advantageously, the axes of the jacks or of the metal rods are positioned vertically. The device 10 may further comprise ball joints 31 (visible in FIG. 2) between each deforming member 19 and the envelope 12. The ball joints 31 improve the bond between the deforming members 19 and the envelope 12 which is deformed by the action of the members 19. By way of example, the ball joint 31 allows the rotation around three orthogonal axes of the surface element of the envelope 12 as regards the corresponding deforming member 19. Indeed, while the member 19 acts on the envelope 12, the latter is submitted to displacements related to the member 19. In particular, the device 10 may include a disk 32 (visible in FIG. 2) between the ball joint 31 and the envelope 12. The ball joint 31 then allows the rotation of the disk 32 around three axes of the disk 32. The disk 32 further reinforces the envelope 12 locally in order to reduce even more the risks of tearing the envelope 12, and hence the mould 14. The disk 32 may be moulded in the envelope 12, in particular in the bottom portion 121 of the envelope 12. The disk 32 is thus integral with the envelope 12. The disk 32 may also be simply intercalated between the ball joint 31 and the envelope 12. Adaptation of the deforming members 19 to a more random arrangement is thus facilitated. By way of example, to allow the disk 32 or the surface element of the envelope 12 to rotate, the ball joint 31 may correspond to a stud made of a deformable material, for example rubber.

According to the first example of an embodiment, the device 10 may further comprise a table 24. The envelope 12 at rest, is on the table 24. Thus, the introduction of the material to be moulded into the mould 14 is facilitated. While the bottom portion 122 of the envelope 12 rests on the table 24 and the bottom shell 142 rests on the portion 122, it is indeed possible to spread the material easily over the bottom shell 142. The deforming members 19 extend through the table 24. When the device 10 is activated, the deforming members 19 lift the envelope 12 from the table 24. The members 19 lift the envelope 12 locally so as to create a local deformation of the mould 14. The members 19 extend from beneath the table 24 to the point of contact with the envelope 12, through the table 24. The table 24 therefore has openings 26 for the passage of the members 19.

The deformation of parts which, at rest, may for example measure approximately 5 $m^2$ may be obtained by the device 10. The deforming members 19 are regularly or not regularly arranged, beneath the surface of the envelope 12. Preferably, the members 19 are arranged regularly in a grid pattern. The deformation of the mould 14 can thus be better controlled.

In addition to the envelope 12, the device 10 further comprises an additional means 30 making it possible to apply pressure on the mould 14, at least after the mould 14 has been deformed. In the first example of an embodiment, the additional means 30 corresponds to a load 30 which is designed to be placed on the envelope 12, when the mould 14 is placed in the envelope 12 during the process for production of moulded parts, as will be described in greater detail below. The load 30 corresponds to one or more massive elements, for example weights. By way of example, in FIG. 1 the load 30 is constituted of three massive elements, each weighing, for example, several kilograms. Preferably, pressure is applied over the major portion of the mould 14 by the load 30 through the envelope 12. Preferably the pressure applied by the load 30 is distributed substantially uniformly over the major portion of the mould 14 through the envelope 12. By way of example, the load 30 may correspond to several bags of sand arranged over the mould 14 with interposition of the envelope 12. According to another example, the load 30 may correspond to a container in which juxtaposed compartments are provided, each compartment containing sand and/or water. The container may thus be placed so as to cover the mould 14, with interposition of the envelope 12. The compartments filled with sand and/or water are thus arranged over the major portion of the mould 14 and ensure that pressure is applied uniformly on the mould 14.

The invention also relates to a process for the production of parts. The parts may be of concrete, preferably high-performance fibre-reinforced concrete. Thin parts, a few millimeters in thickness, may be produced with this type of concrete.

Generally, the production process comprises a step of introducing a material to be moulded into the mould 14. The process then comprises a step of placing the mould 14 in the envelope 12. The envelope 12 is closed and a low pressure is created in the envelope 12 by the formation of a gas flow through the vacuum port 15. The low pressure in the envelope 12 may even propagate into the mould 14, attention being drawn to the fact that the material to be moulded does not escape from the mould 14. The process then comprises a step of deforming the mould 14. The process further comprises a step of stopping the gas flow after the creation of the low pressure in the envelope 12, this step being possible to be carried out before or after the deformation of the mould 14. The process then comprises a step of applying pressure, by the means 30 different from the envelope and the deforming members, on at least a portion of the mould 14, at least after the gas flow is stopped.

The material dries (or sets) at the same time as the mould 14 is deformed. Thus, a part having a particular shape is obtained, which may give an aesthetic aspect to a structure. Preferably, the process is repeated so as to obtain a plurality of parts with a particular shape. The parts may then, be assembled so that the obtained jigsaw offers an aesthetic impression. Parts having a low thickness (for example 15 mm) may in particular be moulded by the process according to the invention. Indeed, the thickness of the material is controlled throughout the duration of the process.

FIGS. 3 to 6 represent the moulding device 10 according to the first example of an embodiment of the invention at successive steps of an example of production process of a moulded part.

Figure 3:
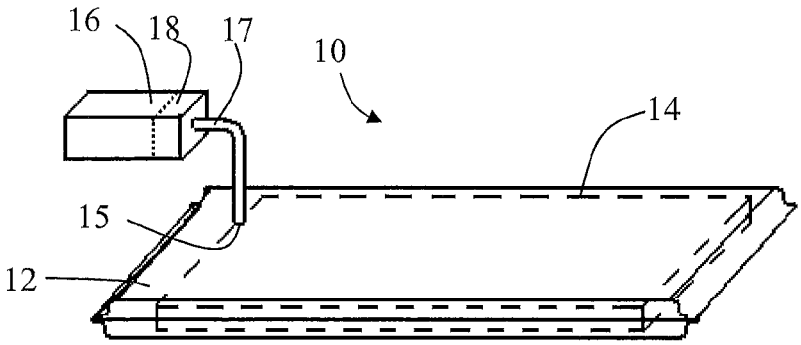
FIGS. 3 to 6 represent the moulding device according to the first example of an embodiment of the invention in successive steps of an example of the production process of moulded parts according to the invention.

FIG. 3 represents the device 10 after the moulding material has been placed into the mould 14 and the mould 14 has been placed in the envelope 12. The mould 14 is shown by the dashed lines in FIG. 3. The vacuum port 15 of the envelope 12 is connected to the vacuum pump 16, which is not functioning in FIG. 3. By way of example, the bottom portion 122 of the envelope 12 may first be placed on the table 24 (not shown in FIG. 3). The mould 14 is placed in the envelope 12 in the sense that, during an initial period, only the bottom shell 142 is placed on the bottom portion 122 of the envelope 12. The bottom portion 122 and the bottom shell 142 lie flat. This arrangement facilitates the step of introducing the material to be moulded into the mould 14 and the spreading of the material over the entire surface of the mould 14. In particular, the thickness of the material is thus better controlled. The mould 14 and the envelope 12 being arranged horizontally, the material to be moulded does not flow inside the mould 14. Advantageously, the draining element 20 may be placed on the bottom portion 122, before the bottom shell 142 is put into place. This favours the creation of the low pressure within the envelope 12. After the material is put onto the bottom shell 142, the mould 14 is closed by placing the top shell 141 on the bottom shell 142. Advantageously, the draining element 22 is placed between the material and the top shell 141. The draining element 22 favours the propagation of the low pressure within the mould 14. The draining element 22 also gives the material a better appearance once the process is completed. The draining element 22 indeed reduces the risk trapping air bubbles in the mould 14, which would give a cracked appearance to the surface of the part to be moulded. By way of a variant, before the mould 14 is closed, the insert-guiding element is placed between the material and the top shell 141. Inserts are then inserted completely or partially into the material to be moulded, using the openings in the guiding element as a guide so that the inserts can penetrate into the material to be moulded. The envelope 12 is then closed over the mould 14, by placing the top portion 121 of the envelope 12 on the top shell 141. Advantageously, a draining element 20 may also be placed between the top portion 121 and the top shell 141. This draining element 20 favours the creation of the low pressure and also reduces the risk of air bubbles being trapped in the envelope 12, these air bubbles having the harmful effects described above.

Figure 4:
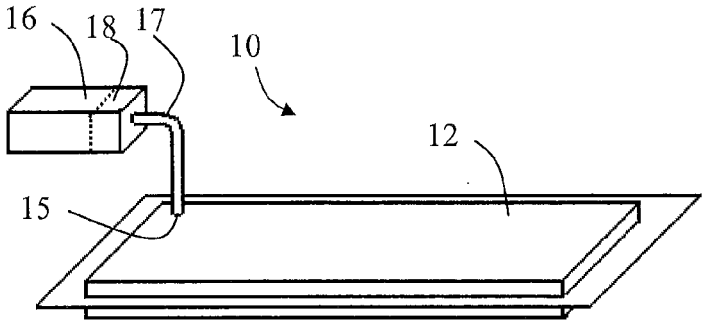

FIG. 4 represents the device 10 after a low pressure has been created in the envelope 12. The low pressure is obtained by turning on the vacuum pump 16. The envelope 12 then takes on the shape of the mould 14 containing the material to be moulded. Under the effect of the low pressure, the envelope 12 is pressed against the mould 14 (optionally by the draining elements 20, if necessary). This low pressure can propagate within the mould 14. This low pressure induces the formation of a biscuit, composed of the envelope 12 and the mould 14 confining the material to be moulded, which is sufficiently rigid so that the material does not flow in the mould 14 but which is also sufficiently flexible to be submitted to a deformation by the deforming members 19. Another advantage is that the thickness of the material confined in the mould 14 remains substantially constant during the production process. A moulded part of substantially constant thickness is thus obtained. In the rest of the description, the assembly constituted by the envelope 12 and the mould 14, the mould 14 being placed in the envelope 12 and a low pressure being created in the envelope 12, is called the envelope 12-mould 14 assembly.

Figure 5:
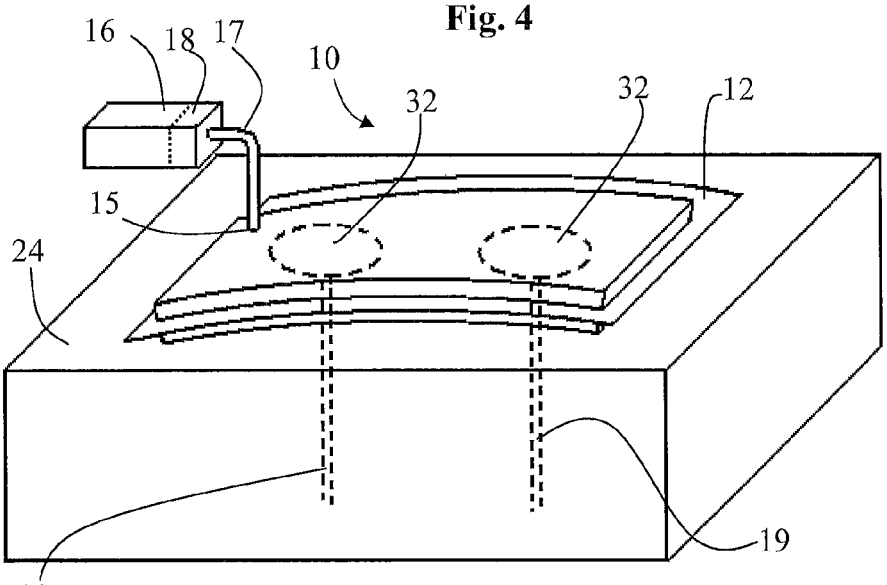

FIG. 5 represents the device 10 after the envelope 12-mould 14 assembly has been placed on the table 24 and after the deforming members 19, i.e. the jacks (shown by the dashed lines) in the first example of an embodiment, have been activated. The deformation of the mould 14 may take place by the deforming members 19 acting on the envelope 12. Depending on the desired shape of the part to be obtained, the deforming members 19 are adjusted independently of each other. The members 19 act on the envelope 12 to a greater or lesser extent. To do so, the members 19 lift the envelope 12 to a greater or lesser extent, independently of each other.

Figure 6:
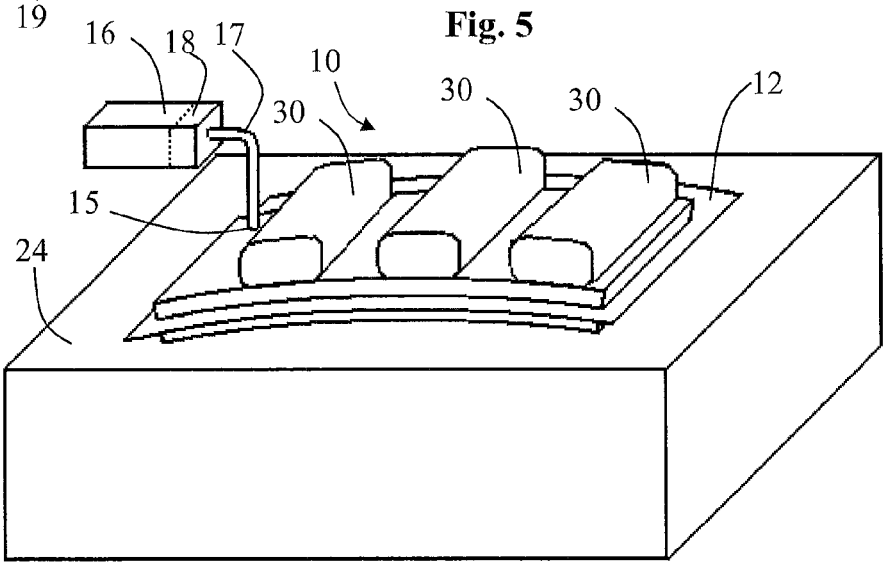

FIG. 6 shows the device 10 after the following steps have been carried out:

placing the load 30 on the envelope 12-mould 14 assembly;

blocking the air flow through the vacuum port 15; and interrupting the operation of the vacuum pump 16.

As described above, the interruption of the operation of the vacuum pump 16 can automatically block the flow of air through the vacuum port 15. The operation of the vacuum pump 16 may be interrupted before or after the load 30 has been put into place, even before the envelope 12-mould 14 assembly has been deformed by the deforming members 19. After the vacuum pump 16 is turned off, the pressure in the envelope 12 slowly rises, in particular due to leaks at the level of the envelope 12. However, the presence of the load 30 prevents the mould 14 from shifting and in particular the top shell 141 from shifting relative to the bottom shell 42. After the moulding material has set, the mould 14 may be removed from the envelope 12.

After a defined period of time, the part is removed from the mould 14. The obtained part has a surface which may include humps and hollows. The obtained part is a three-dimensional object with a locally variable curvature. The curvature may locally have a positive or negative sign. Preferably, there is no singularity or discontinuity. If a single deforming member 19 is implemented, the surface may have a single hump. If several members 19 are used, then the surface may have a plurality of humps of greater or lesser height and separated by hollows. The humps may then correspond to the locations of the members 19 acting on the envelope 12, while the hollows may correspond to the locations where there are no deforming members 19.

A part may be produced by moulding using the process described above. It is conceivable for the process to be repeated so as to produce several parts by moulding and then assemble these parts between themselves. The parts to be assembled are then modules. The surface thus produced is itself a three-dimensional object with a locally variable curvature. The curvature may locally have a positive or negative sign. Preferably, there is no singularity or discontinuity. A larger area (for example 8000 $m^2$) may then be obtained by producing smaller parts (for example up to 20 $m^2$, preferably 5 $m^2$, more preferably 2 $m^2$, even more preferably 1 $m^2$). Advantageously, the deforming members act in the same way on the edges of two parts that are intended to be contiguous in the assembly, so as to be able to assemble the parts between themselves by their edges and that the obtained assembly is continuous from one part to the other. The advantage of the device and of the process is that the parts obtained and joined together are thin, therefore relatively less heavy.

Figure 7:
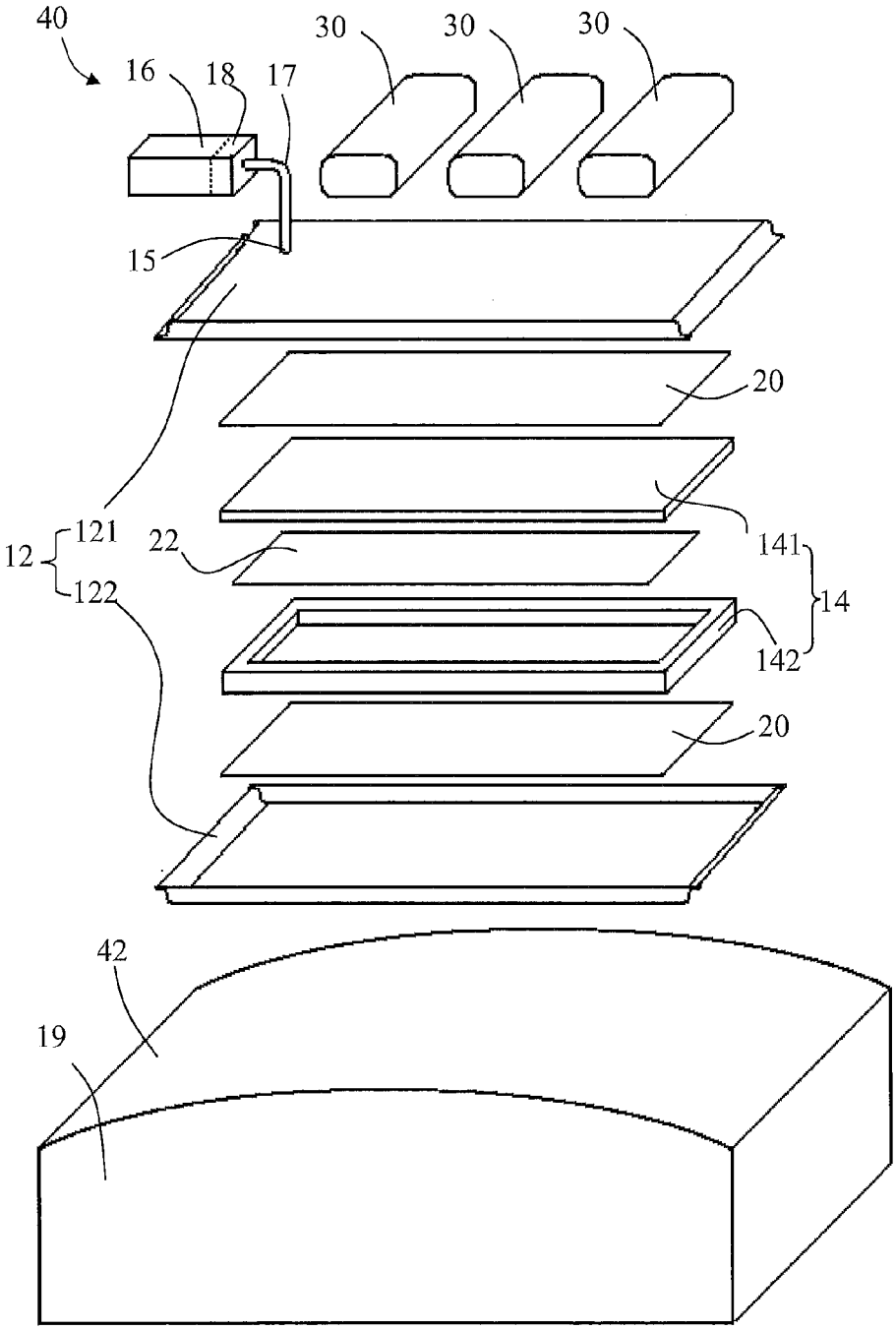
FIG. 7 is an exploded diagrammatic view in perspective of a moulding device according to a second example of an embodiment of the invention.

FIG. 7 represents a moulding device 40 according to a second example of an embodiment of the invention. According to the second example of an embodiment, the deforming member 19 corresponds to a template. The advantage is that the deformation of the envelope 12-mould 14 assembly may be applied in an easily reproducible manner and for a lower cost. The template 19 comprises a face 42 against which the envelope 12-mould 14 assembly is applied once the low pressure is created in the mould 14. By placing the envelope 12-mould 14 assembly on the face 42 of the template 19, the template 19 acts on the envelope 12 so as to deform the mould 14. The template 19 has for example the shape of a horse saddle, a spherical portion, a cylindrical portion (as shown in FIG. 7) and, in general, a curved surface in three dimensions. In FIG. 7, the load 30 is represented by three massive elements. By way of a variant, the load 30 may correspond to a counter-template having a face with a complementary shape to the shape of the template 19 and which is designed to cover the envelope 12-mould 14 assembly. The counter-template is constituted of a sufficiently heavy material to apply sufficient pressure on the mould 14 through the envelope 12.

Figure 8:
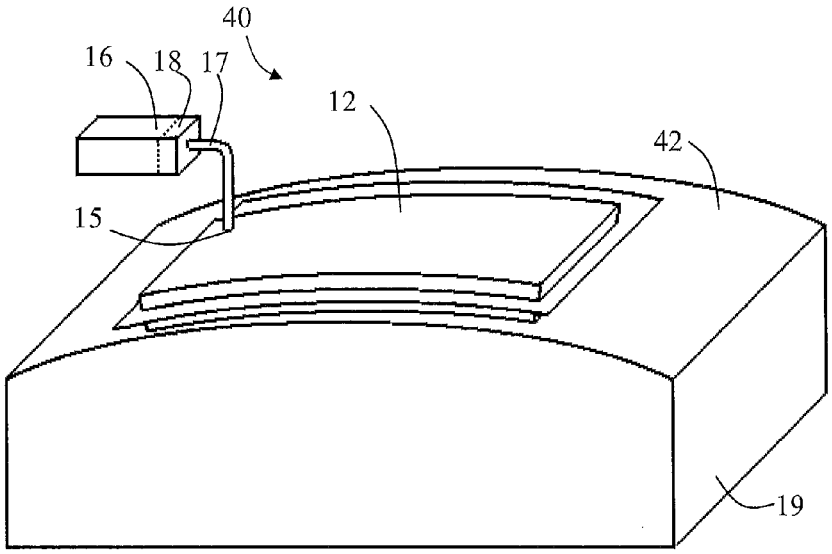
FIGS. 8 and 9 represent the moulding device according to the second example of an embodiment of the invention in successive steps of an example of the production process of moulded parts according to the invention.
Figure 9:
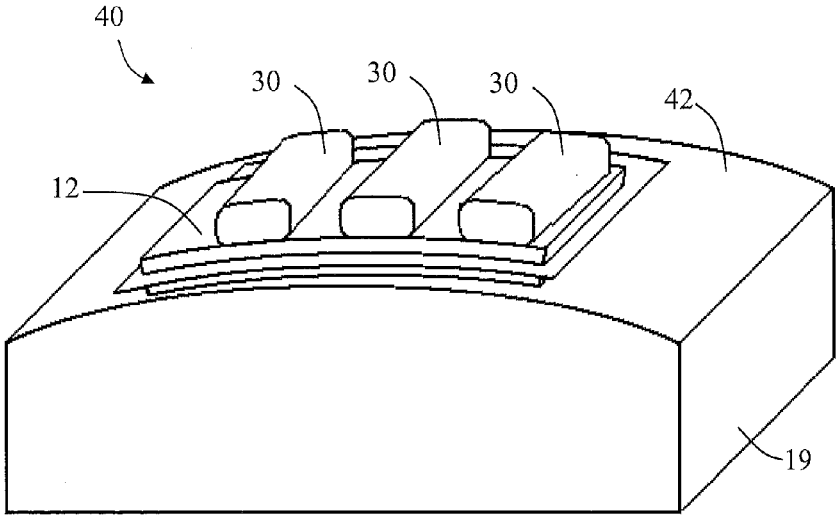

FIGS. 8 and 9 represent the moulding device 40 according to the second example of an embodiment in successive steps of an example of the process for production of a moulded part.

The initial steps of the process are identical to those described above in relation to FIGS. 3 and 4.

FIG. 8 represents the device 40 after the envelope 12-mould 14 assembly is pressed against the deforming member 19, i.e. a template in the second example of an embodiment. The envelope 12-mould 14 assembly deforms to take on the shape of the face 42 of the template 19.

FIG. 9 represents the device 40 after the following steps have been carried out:

placing the load 30 on the envelope 12-mould 14 assembly;

blocking the air flow passing through the vacuum port 15; and interrupting the operation of the vacuum pump 16.

As described above, the interruption of the operations of the vacuum pump 16 may induce an automatic blocking of the flow of air by the vacuum port 15. The operation of the vacuum pump 16 may be interrupted before or after the load 30 has been put into place, even before the envelope 12-mould 14 assembly has been applied on the template 19. The pressure in the envelope 12 then slowly rises, in particular due to leaks at the level of the envelope 12. However, the presence of the load 30 prevents the mould from shifting and in particular prevents the top shell 141 from shifting relative to the bottom shell 142. After the moulding material sets, the mould 14 can be removed from the envelope 12 and the moulding material can be demoulded.

In the examples of the embodiments described above, in addition to the envelope 12, the additional means 30 allowing pressure to be applied on the mould 14 corresponds to a load placed on the mould 14 with interposition of the envelope 12. However, it is clear that the additional means 30 may correspond to any type of system making it possible to keep the mould 14 in place pressed against the deforming member 19. By way of example, the additional means 30 may correspond to a fastening system of the mould 14 to the template 19, for example a set of straps or jaws keeping the mould 14 pressed against the template 19. Preferably, the additional means 30 allows pressure to be applied on the mould 14 as uniformly as possible over the largest possible portion of the mould 14 opposite the template 19.

The material used to produce the part by the process and the device is preferably ultra-high performance fibre-reinforced concrete (UHPFC). This part has for example a thickness of 5 to 50 mm. Very thin parts may thus be obtained. Preferably the part has a thickness of approximately 15 mm.

Ultra-high performance fibre-reinforced concretes are concretes having a cementitious matrix containing fibres. The reader may refer to the document entitled "Bétons fibrés à ultra-hautes performance [Ultra-high performance fibre-reinforced concrete]" by SETRA (French Road and Motorway Technical Studies Service) and the AFGC (French Civil Engineering Association). The compressive strength of these concretes is generally greater than 150 MPa, even greater than 250 MPa. The fibres may be metal fibres, organic fibres, or correspond to a mix of organic and metal fibres. The binder content is high (i.e. the W/C ratio is low, generally the W/C ratio is at most approximately 0.3).

The cementitious matrix generally comprises cement (Portland cement), an element with a pozzolanic reaction (in particular silica fume) and a fine sand. The respective particle sizes are within chosen ranges, depending on the respective nature and quantities thereof.

By way of examples of cementitious matrices, mention may be made of the matrices described in patent applications EP-A-518 777, EP-A-934 915, WO-A-95/01316, WO-A-95/01317, WO-A-99/28267, WO-A-99/58468, WO-A-99/23046, WO-A-01/58826, and WO-2008/056065, to which the reader may refer for further details.

The invention claimed is:

1. A production process of a concrete moulded part, comprising:

pouring unset concrete into a flexible mould, the flexible mould comprising a bottom shell and a top shell on the bottom shell closing the flexible mould, the concrete being confined in the flexible mould;

placing the flexible mould in a flexible envelope comprising a vacuum port;

creating a low pressure in the flexible envelope formed by a gas flow out of the flexible envelope passing through the vacuum port;

deforming the flexible mould by a deforming member located beneath the mould, said deforming member acting on the envelope to deform the flexible mould, the flexible mould lying horizontally when the deforming member is not deforming the mould;

stopping the gas flow out of the flexible envelope with an obturating element when the low pressure has been created in the flexible envelope;

applying pressure, by a pressure module different from the flexible mould, the envelope and the deforming member, on at least a portion of the flexible mould, optionally with interposition of the flexible envelope, at least after the gas flow out of the flexible envelope has stopped, said pressure being applied on the at least a portion of the flexible mould so that the top shell is prevented from shifting relative to the bottom shell, and after the concrete has set, removing the mould from the envelope and removing the concrete moulded part from the flexible mould.

2. The process according to claim 1, wherein the vacuum port is connected to a vacuum pump using a connecting element, wherein creating the low pressure comprises turning the vacuum pump on and wherein stopping the gas flow comprises turning the vacuum pump off.

3. The process according to claim 2, wherein stopping the gas flow comprises at least partially obturating the connecting element.

4. The process according to claim 1, wherein the mould comprises at least first and second opposing faces, to which the deforming member applies a first pressure on the flexible mould, with interposition of the flexible envelope, on the side of the first face, and to which said pressure module applies a second pressure on the flexible mould, with interposition of the flexible envelope, on the side of the second face.

5. The process according to claim 4, wherein said pressure module applies a substantially uniform second pressure on the flexible mould, with interruption of the envelope, over more than half of the second face.

6. The process according to claim 1, wherein applying pressure comprises placing at least one load on at least a portion of the flexible mould, optionally with interposition of the flexible envelope.

7. The process according to claim 1, wherein the pressure module includes a load having a mass greater than 1 kg.

8. The process according to claim 7, wherein the load is a container that includes a plurality of juxtaposed compartments.

9. The process according to claim 1, wherein the deforming member is a jack or a template.

* * * * *